US011410582B2

(12) United States Patent
Ha et al.

(10) Patent No.: US 11,410,582 B2
(45) Date of Patent: Aug. 9, 2022

(54) SENSING DEVICE AND ELECTROLUMINESCENCE DISPLAY DEVICE INCLUDING THE SAME

(71) Applicant: LG Display Co., Ltd., Seoul (KR)

(72) Inventors: Sung-Chul Ha, Paju-si (KR); Man-Gyu Park, Paju-si (KR); Mi-So Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/119,754

(22) Filed: Dec. 11, 2020

(65) Prior Publication Data

US 2021/0201718 A1 Jul. 1, 2021

(30) Foreign Application Priority Data

Dec. 26, 2019 (KR) ..... 10-2019-0175768

(51) Int. Cl.
*G09G 3/00* (2006.01)

(52) U.S. Cl.
CPC ..... *G09G 3/006* (2013.01); *G09G 2330/12* (2013.01)

(58) Field of Classification Search
CPC ..... G06F 3/0412; G09G 3/006; G09G 3/3225–325; G09G 2330/12; G09G 2320/0233
See application file for complete search history.

(56) References Cited

U.S. PATENT DOCUMENTS

| | | | | |
|---|---|---|---|---|
| 9,349,311 | B2 | 5/2016 | Yu et al. | |
| 9,542,873 | B2 | 1/2017 | Yu et al. | |
| 2015/0379909 | A1 | 12/2015 | Yu et al. | |
| 2016/0240122 | A1 | 8/2016 | Yu et al. | |
| 2017/0046006 | A1* | 2/2017 | Kim | G06F 3/0412 |

FOREIGN PATENT DOCUMENTS

| | | | |
|---|---|---|---|
| KR | 10-1529005 | B1 | 6/2015 |

* cited by examiner

*Primary Examiner* — Hang Lin
(74) *Attorney, Agent, or Firm* — Fenwick & West LLP

(57) ABSTRACT

Disclosed herein is a sensing device including a sensing channel terminal connected to a pixel through a sensing line, a first power terminal to which a displaying reference voltage is input, a second power terminal to which a sensing reference voltage different form the displaying reference voltage is input, a third power terminal to which a sampling reference voltage is input, a sampling capacitor having a first electrode to which the sampling reference voltage is applied, a sensing set-up switch connected between the second power terminal and the sensing channel terminal, a first sampling switch connected between the sensing channel terminal and a second electrode of the sampling capacitor, and a second sampling switch connected between the first power terminal and the second electrode of the sampling capacitor.

20 Claims, 8 Drawing Sheets

SENSING DEVICE AND ELECTROLUMINESCENCE DISPLAY DEVICE INCLUDING THE SAME

CROSS-REFERENCE TO RELATED APPLICATIONS

This application claims the benefit of Republic of Korea Patent Application No. 10-2019-0175768, filed on Dec. 26, 2019, which is hereby incorporated by reference in its entirety.

BACKGROUND

Field of the Technology

The present disclosure relates to an electroluminescence display device.

Discussion of the Related Art

An active matrix type of electroluminescence display device are formed by arranging pixels including a light emitting element and a driving element in the form of a matrix and adjusts brightness of an image embodied in pixels depending on a gray scale of image data. The driving element controls pixel current flowing in a light emitting element depending on a voltage (hereinafter, "gate-source voltage") between a gate electrode and a source electrode of the driving element. The amount of emitted light from the light emitting element and the brightness of an image are determined depending on pixel current.

The threshold voltage, the electron mobility, and the like of the driving element determine driving characteristics of a pixel, and thus, need not to be changed in all pixels. However, driving characteristics between pixels may be changed for various reasons such as a process deviation or a degradation deviation. Such a difference between driving characteristics causes a brightness deviation and has a limit in embodying a desired image. In order to compensate for a brightness deviation between pixels, an external compensation technology of sensing the driving characteristics of pixels and correcting data of an input image based on the sensing result has been known.

In the external compensation technology, the sensing result of the driving characteristics of pixels is converted into a digital value through an analog to digital converter (ADC) and is then used to correct image data. The ADC is mounted on a driver integrated circuit with a sensing unit for sensing the driving characteristics of pixels.

The output characteristics of the ADC are sensitive to a temperature variation. When the output characteristics of the ADC are changed due to a temperature variation, the sensing result of the driving characteristics of pixels is distorted and compensation performance may be degraded.

SUMMARY

To overcome the aforementioned problem of the related art, the present disclosure may provide a sensing device and an electroluminescence display device including the same for enhancing compensation capability by sensing both the driving characteristics of pixels and the output characteristics of an analog to digital converter (ADC) in a single sensing sequence.

To achieve these objects and other advantages and in accordance with the purpose of the disclosure, as embodied and broadly described herein, a sensing device includes a sensing channel terminal connected to a pixel through a sensing line, a first power terminal to which a displaying reference voltage is input, a second power terminal to which a sensing reference voltage different form the displaying reference voltage is input, a third power terminal to which a sampling reference voltage is input, a sampling capacitor having a first electrode to which the sampling reference voltage is applied, a sensing set-up switch connected between the second power terminal and the sensing channel terminal, a first sampling switch connected between the sensing channel terminal and a second electrode of the sampling capacitor, and a second sampling switch connected between the first power terminal and the second electrode of the sampling capacitor, wherein, in one sensing sequence in which a scan signal applied to the pixel is maintained in an on-level, the first sampling switch and the second sampling switch are alternately and selectively turned on.

In another aspect of the present disclosure, a sensing device includes a sensing channel terminal connected to a pixel through a sensing line, a first power terminal to which a displaying reference voltage is input, a second power terminal to which a sensing reference voltage different form the displaying reference voltage is input, a third power terminal to which a sampling reference voltage is input, a sampling capacitor having a first electrode to which the sampling reference voltage is applied, a dummy sampling capacitor having a first electrode to which the sampling reference voltage is applied, a sensing set-up switch connected between the second power terminal and the sensing channel terminal, a first sampling switch connected between the sensing channel terminal and a second electrode of the sampling capacitor, and a second sampling switch connected between the first power terminal and a second electrode of the dummy sampling capacitor, wherein, in one sensing sequence in which a scan signal applied to the pixel is maintained in an on-level, the first sampling switch and the second sampling switch are alternately and selectively turned on.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
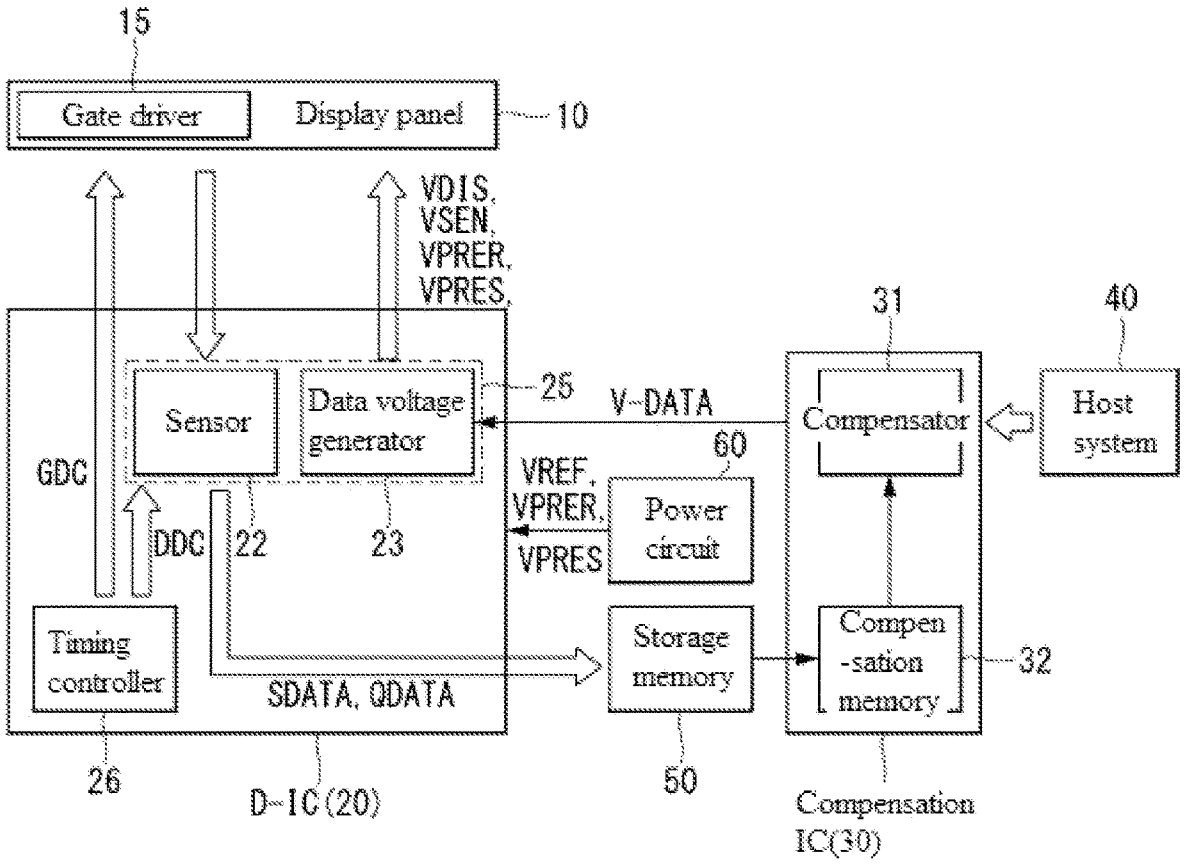
FIG. 1 is a block diagram showing an electroluminescence display device according to an embodiment of the present disclosure.

Hereinafter, the present disclosure will be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art.

The shapes, sizes, ratios, angles, numbers and the like disclosed in the drawings for description of various embodiments of the present disclosure to describe embodiments of the present disclosure are merely exemplary and the present disclosure is not limited thereto. Like reference numerals refer to like elements throughout. Throughout this specification, the same elements are denoted by the same reference numerals. As used herein, the terms "comprise", "having," "including" and the like suggest that other parts can be added unless the term "only" is used. As used herein, the singular forms "a", "an", and "the" are intended to include the plural forms as well, unless context clearly indicates otherwise.

Elements in various embodiments of the present disclosure are to be interpreted as including margins of error even without explicit statements.

With regard to the following description of the present disclosure, in describing positional relationships, phrases such as "an element A on an element B," "an element A above an element B," "an element A below an element B" and "an element A next to an element B," another element C may be disposed between the elements A and B unless the term "immediately" or "directly" is explicitly used.

With regard to the following description of the present disclosure, in describing elements, terms such as "first" and "second" are used, but the elements are not limited by these terms. These terms are simply used to distinguish one element from another. Accordingly, as used herein, a first element may be a second element within the technical idea of the present disclosure.

In the specification, a pixel circuit formed on a substrate of a display panel may be embodied as a thin film transistor (TFT) with an n-type metal oxide semiconductor field effect transistor (MOSFET) structure or a TFT with a p-type MOSFET structure. The TFT is a 3-electrode device including a gate, a source, and a drain. The source is an electrode for supplying a carrier to a transistor. In the TFT, a carrier begins to flow from the source. The drain may be an electrode at which a carrier gets out of the TFT. That is, in the MOSFET, a carrier flows to the drain from the source. In the case of an n-type TFT (NMOS), a carrier is an electron, and thus, as the carrier flows to the drain from the source, a source voltage is lowered compared with a drain voltage. In the n-type TFT, an electron flows to the drain from the source, and thus, current flows in a direction to the source from the drain. In contrast, in the case of the p-type TFT (PMOS), a carrier is a hole, and thus, as the hole flows to the drain from the source, a source voltage may be raised compared with a drain voltage. In the p-type TFT, a hole flows to the drain from the source, and thus, current flows to the drain from the source. It may be noted that the source and drain of the MOSFET are not fixed. For example, the source and drain of the MOSFET may be changed depending on an applied voltage.

In the specification, a semiconductor layer of the TFT may be embodied as at least one of an oxide device, an amorphous silicon device, or a poly silicon device.

Hereinafter, embodiments of the present disclosure will be described in detail. In the following description of the present disclosure, a detailed description of known functions and configurations incorporated herein will be omitted when it may make the subject matter of the present disclosure unclear.

Figure 2:
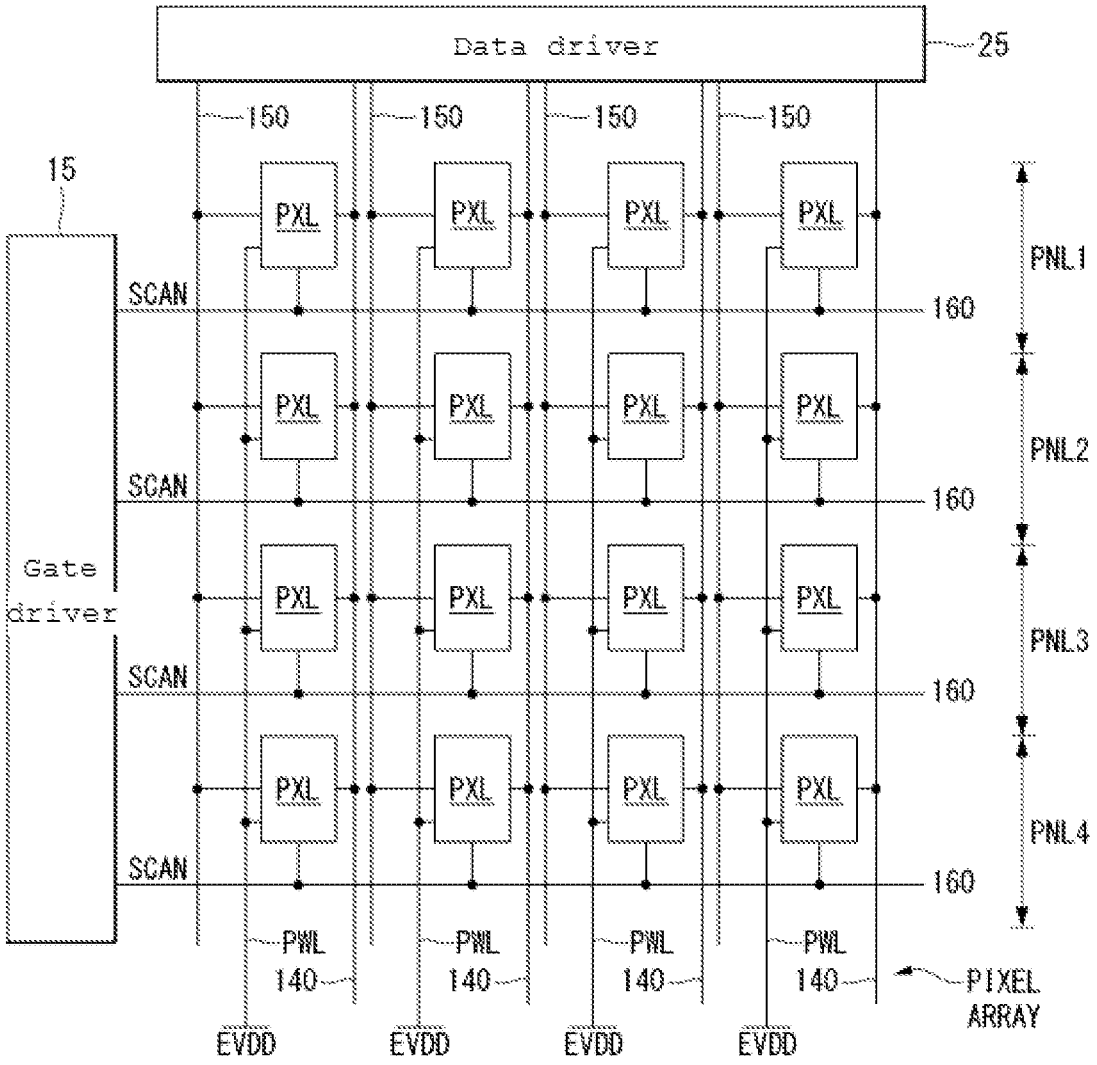
FIG. 2 is a diagram showing an example of a pixel array included in a display panel of FIG. 1 according to an embodiment of the present disclosure.

FIG. 1 is a diagram showing an electroluminescence display device according to an embodiment of the present disclosure. FIG. 2 is a diagram showing an example of a pixel array included in a display panel of FIG. 1.

Referring to FIGS. 1 and 2, the electroluminescence display device according to an embodiment of the present disclosure may include a display panel 10, a driver integrated circuit (D-IC) 20, a compensation integrated circuit (IC) 30, a host system 40, a storage memory 50, and a power circuit 60. A panel driver for driving the display panel 10 may include a gate driver 15 included in the display panel 10, and a data driver 25 installed in the driver integrated circuit (D-IC) 20.

The display panel 10 may include a plurality of pixel lines PNL1 to PNL4, and each pixel line may include a plurality of pixels PXL and a plurality of signal lies. The "pixel line" described in the present disclosure may refer to a set of signal lines and the pixels PXL that are adjacent to each other in an extension line of a gate line, but not a physical signal line. The signal lines may include data lines 140 for selectively supplying a displaying data voltage VDIS and a sensing data voltage VSEN to the pixels PXL, reference voltage lines 150 for selectively supplying a displaying reference voltage VPRER and a sensing reference voltage VPRES to the pixels PXL, gate lines 160 for supplying a scan signal to the pixels PXL, and high potential power lines PWL for supplying a high potential pixel voltage EVDD to the pixels PXL.

The pixels PXL of the display panel 10 may be arranged in a matrix form to configure a pixel array. Each pixel PXL included in the pixel array of FIG. 2 may be connected to any one of the data lines 140, any one of the reference voltage lines 150, any one of the high potential power lines PWL, and any one of the gate lines 160. Each pixel included in the pixel array of FIG. 2 may also be connected to the plurality of gate lines 160. Each pixel PXL included in the pixel array of FIG. 2 may further receive a low potential pixel voltage from the power circuit 60. The power circuit 60 may supply a low potential pixel voltage to the pixel PXL through a low potential power line or a pad unit.

The gate driver 15 may be installed in the display panel 10.

The gate driver 15 may include a plurality of gate stages connected to the gate lines 160 of the pixel array of FIG. 2. The gate stages may generate a scan signal for controlling switch devices of the pixels PXL and may supply the scan signal to the gate lines 160.

The driver integrated circuit (D-IC) 20 may include a timing controller 26 and the data driver 25, but the present disclosure is not limited thereto. The timing controller 26 may also be installed on a control board with the driver integrated circuit (D-IC) 20 rather than being included in the driver integrated circuit (D-IC) 20. The data driver 25 may include a sensor 22 and a data voltage generator 23, but the present disclosure is not limited thereto.

The timing controller 26 may generate a gate timing control signal GDC for controlling operation timing of the gate driver 15 and a data timing control signal DDC for controlling operation timing of the data driver 25 with reference to timing signals input from the host system 40, e.g., a vertical synchronization signal Vsync, a horizontal synchronization signal Hsync, a dot clock signal DCLK, and a data enable signal DE.

The data timing control signal DDC may include a source start pulse, a source sampling clock, a source output enable signal, and the like, but the present disclosure is not limited thereto. The source start pulse may control data sampling start timing of the data voltage generator 23. The source sampling clock may be a clock signal for controlling sampling timing of data based on a rising or falling edge. The source output enable signal may control output timing of the data voltage generator 23.

The gate timing control signal GDC may include a gate start pulse, a gate shift clock, and the like, but the present disclosure is not limited thereto. The gate start pulse may be applied to a gate stage for generating a first gate output and may activate an operation of the stage. The gate shift clock may be commonly applied to gate stages and may be a clock signal for shifting the gate start pulse.

The timing controller 26 may sense driving characteristics of the pixels PXL from at least one of a power on period, a vertical active period of each frame, a vertical blank period of each frame, or a power off period by controlling operation timing of a panel driving circuit. Here, the power on period may be a period until a screen is turned on after system power is supplied, and the power off period may be a period until system power is released after the screen is turned off. The vertical active period may be a period in which image data for image reproduction is written in the display panel 10, and the vertical blank period may be a period that is positioned between adjacent vertical active periods and in which writing of image data is stopped. The driving characteristics of the pixels PXL may include the threshold voltage and electron mobility of driving elements included in the pixels PXL.

The timing controller 26 may perform display driving and sensing driving by controlling sensing driving timing and display driving timing with respect to the pixel lines PNL1 to PNL4 of the display panel 10 according to a predetermined sequence.

The timing controller 26 may differently generate timing control signals GDC and DDC for display driving and the timing control signals GDC and DDC for sensing driving. The sensing driving means that the sensing data voltage VSEN is written in the pixels PXL included in a sensing target pixel line, the output characteristics of an ADC depending on a temperature as well as the driving characteristics of the corresponding pixels PXL are sensed, and a compensation value for compensating for a change in the driving characteristics of the corresponding pixels PXL is updated based on digital sensing result data SDATA and QDATA. In addition, the display driving means that digital image data to be input to the corresponding pixels PXL is corrected based on the updated compensation value, the displaying data voltage VDIS corresponding to corrected digital image data CDATA is applied to the corresponding pixels PXL, and an input image is displayed.

The data voltage generator 23 may be embodied as a digital to analog converter (hereinafter, DAC) for converting a digital signal into an analog signal. The data voltage generator 23 may generate the sensing data voltage VSEN required for sensing driving and the displaying data voltage VDIS required for display driving and may supply the same to the data lines 140. The displaying data voltage VDIS may be a digital-analog conversion result with respect to the corrected digital image data CDATA in the compensation IC 30, and may have amplitudes that are different in pixel units depending on a gray scale value and a compensation value. The sensing data voltage VSEN may be differently set in units of pixels of red (R), green (G), blue (B), and white (W) by considering that the driving characteristics of the driving device are different for respective colors.

For sensing driving, the sensor 22 may sense the driving characteristics of the pixels PXL, for example, the threshold voltage of the driving element through sensing lines. The sensing lines may be embodied as the reference voltage lines 150, but the present disclosure is not limited thereto. The sensing lines may be embodied as the data lines 140. The sensor 22 may be embodied as a voltage sensing type sensor for sensing a source voltage of a driving element included in each pixel PXL. The sensor 22 may include a plurality of sample and hold units, a scaling unit, a multiplexer, and an ADC connected to sensing channel terminals. At least one sample and hold units among the plurality of sample and hold units may include a first sampling switch for sampling the driving characteristics of a pixel and a second sampling switch for sampling the output characteristics of an ADC (refer to FIGS. 5 and 7). The sensor 22 may include at least one dummy sample and holding unit that is not connected to sensing channel terminals. In this case, the second sampling switch for sampling the output characteristics of the ADC may be included in the dummy sample and hold unit rather than being included in the sample and holding unit (refer to FIG. 8).

The sensor 22 may sequentially process a plurality of analog sensing values in series using one ADC. The ADC may convert analog sensing voltage into the digital sensing result data SDATA and QDATA according to a predetermined sensing range and may then supply the digital sensing result data SDATA and QDATA to the storage memory 50. The sensing range may include a lower sensing limit and an upper sensing limit. The lower sensing limit may be a sampling reference voltage applied to the sample and holding unit or the dummy sample and holding unit, and the upper sensing limit may be a higher voltage than the sampling reference voltage.

The storage memory 50 may store the digital sensing result data SDATA and QDATA input from the sensor 22 during sensing driving. The storage memory 50 may be embodied as a flash memory, but the present disclosure is not limited thereto.

The compensation IC 30 may include a compensator 31 and a compensation memory 32. The compensation memory 32 may transfer the digital sensing result data SDATA and QDATA read from the storage memory 50, to the compensator 31. The compensation memory 32 may be a random-access memory (RAM), e.g., a double date rate synchronous dynamic RAM (DDR SDRAM), but the present disclosure is not limited thereto. The compensator 31 may calculate compensation offset and compensation gain for each pixel based on the digital sensing result data SDATA and QDATA read from the storage memory 50, may correct image data received from the host system 40 according to the calculated compensation offset and compensation gain, and may supply the corrected digital image data CDATA to the D-IC 20.

The power circuit 60 may generate the displaying reference voltage VPRER, the sensing reference voltage VPRES, and a sampling reference voltage VREF and may supply the same to the D-IC 20. The displaying reference voltage VPRER may be a set-up voltage applied to a source node of a driving element included in a pixel during display driving. The power circuit 60 may change the displaying reference voltage VPRER to a sensing central value included in the ADC sensing range from an initial value (set-up voltage) required for display driving within 1 sensing sequence, thereby enhancing the accuracy of sensing of ADC output characteristics. The sensing reference voltage VPRES may be a set-up voltage applied to a source node of a driving element included in a pixel during sensing driving. The sampling reference voltage VREF may be a voltage required for an operation of the sensor 22. In order to enhance driving stability and sensing accuracy, the displaying reference voltage VPRER, the sensing reference voltage VPRES, and the sampling reference voltage VREF may have difference voltage levels.

Figure 3:
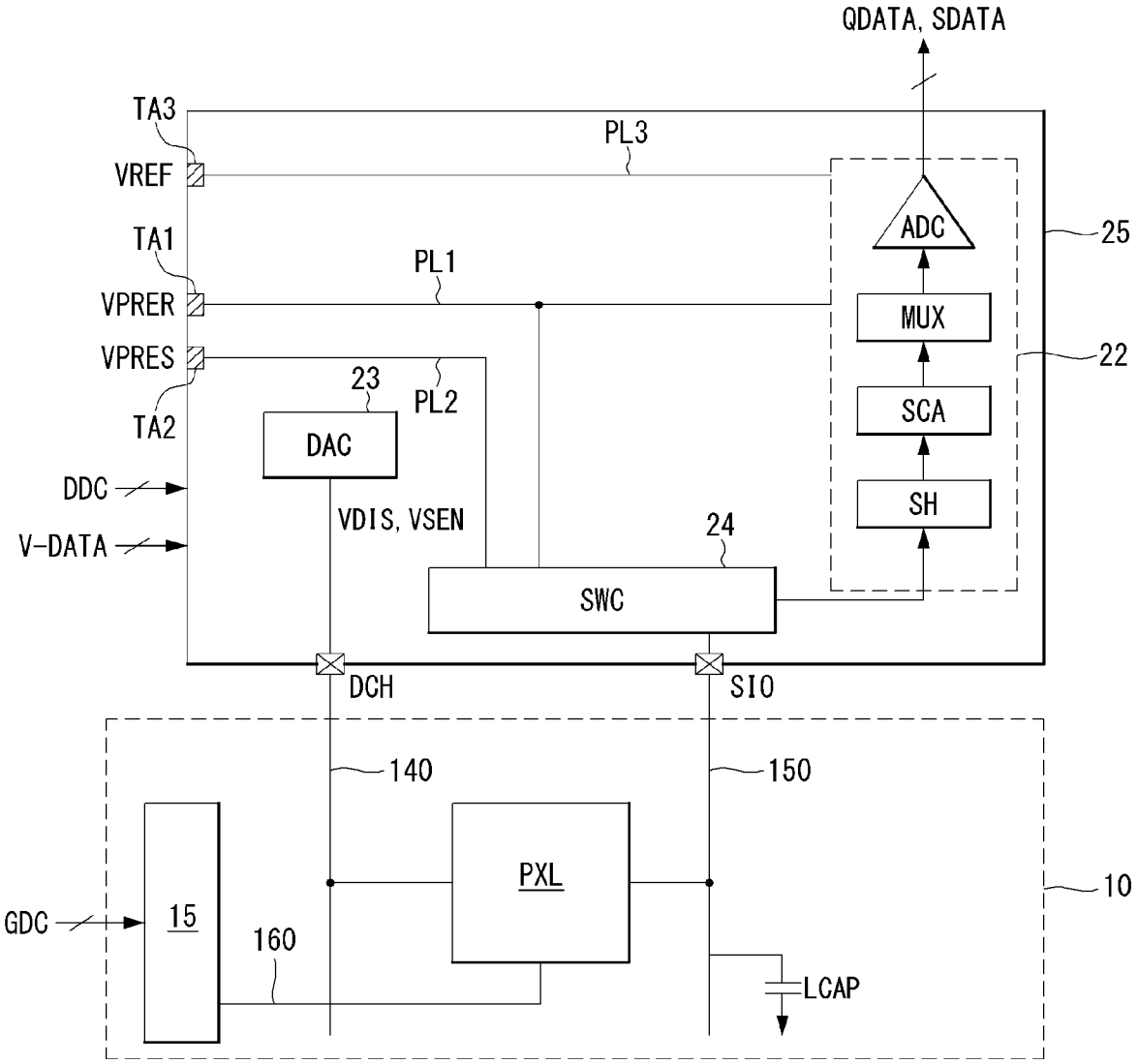
FIG. 3 is a diagram showing a configuration of a data driver connected to the pixel array of FIG. 2 according to an embodiment of the present disclosure.

FIG. 3 is a diagram showing a configuration of the data driver 25 connected to the pixel array of FIG. 2. The data driver 25 of FIG. 3 may sense the driving characteristics of the pixels PXL through the reference voltage lines 150.

Referring to FIG. 3, the data driver 25 may be connected to a first node (which is connected to a gate electrode of a driving element) of the pixel PXL through the data lines 140 and may be connected to a second node (which is connected to a source electrode of a driving element) of the pixel PXL through the reference voltage lines 150. The second node of the pixel PXL may be charged with a source voltage to which the driving characteristics of the pixel PXL are applied, and thus, the reference voltage lines 150 connected to the second node through the second switch device may be used as a sensing line. A line capacitor LCAP for storing the source voltage may be connected to the reference voltage line 150 that function as a sensing line.

The data driver 25 may include the sensor 22, the data voltage generator 23, and a switch circuit SWC 24.

The data voltage generator 23 may be embodied as the digital to analog converter (DAC) for generating the sensing data voltage VSEN and the displaying data voltage VDIS. The data voltage generator 23 may supply the displaying data voltage VDIS to the data lines 140 of the display panel 10 through a data channel terminal DCH during display driving. The data voltage generator 23 may supply the sensing data voltage VSEN to the data lines 140 of the display panel 10 through the data channel terminal DCH during sensing driving.

The switch circuit SWC 24 may be connected to a first power terminal TA1 through a first integrated wiring PL1 and may be connected to a second power terminal TA2 through a second integrated wiring PL2. The displaying reference voltage VPRER may be input to the first power terminal TA1, and the sensing reference voltage VPRES may be input to the second power terminal TA2. The switch circuit SWC 24 may connect the first power terminal TA1 to a sensing channel terminal SIO for a set-up operation during display driving and may connect the second power terminal TA2 to the sensing channel terminal SIO for a set-up operation during sensing driving. When the set-up operation is completed during sensing driving and a sampling operation begins, the switch circuit SWC 24 may disconnect the second power terminal TA2 and the sensing channel terminal SIO from each other.

The sensor 22 may be connected to the sensing channel terminal SIO, may also be connected to the first power terminal TA1 through the first integrated wiring PL1, and may be connected to a third power terminal TA3 through a third integrated wiring PL3 for a sampling operation during sensing driving. The sensor 22 may receive a source node voltage of the pixel PXL from the sensing channel terminal SIO, may receive the displaying reference voltage VPRER from the first power terminal TA1, and may receive the sampling reference voltage VREF from the third power terminal TA3.

The sensor 22 may include a sample and holding unit SH, a scaling unit SCA, a multiplexer MUX, and an ADC. The scaling unit SCA and the multiplexer MUX may also be omitted depending on a model.

The sample and holding unit SH may include a sampling capacitor. A first electrode of the sampling capacitor may be connected to the third power terminal TA3 through the third integrated wiring PL3. The sampling capacitor may primarily store the displaying reference voltage VPRER input from the first power terminal TA1 and may then secondarily store a source voltage of a driving element included in the pixel PXL input from the sensing channel terminal SIO in 1 sensing sequence in which a scan signal applied to a pixel is maintained in an on-level. To this end, the sample and holding unit SH may include two sampling switches for selectively connecting the sampling capacitor to the first power terminal TA1 and the sensing channel terminal SIO.

The scaling unit SCA may receive voltages stored in the sampling capacitor and may shift a level of the voltages according to a sensing range of the ADC. The multiplexer MUX may multiplex outputs of the scaling unit SCA and may supply the multiplexed output to the ADC in an output order. The ADC may be connected to the third power terminal TA3 through the third integrated wiring PL3. The ADC may convert analog outputs input from the scaling unit SCA into a digital value and may output first sensing result data SDATA about the driving characteristics of a pixel and second sensing result data QDATA about the output characteristics of an ADC.

Figure 4:
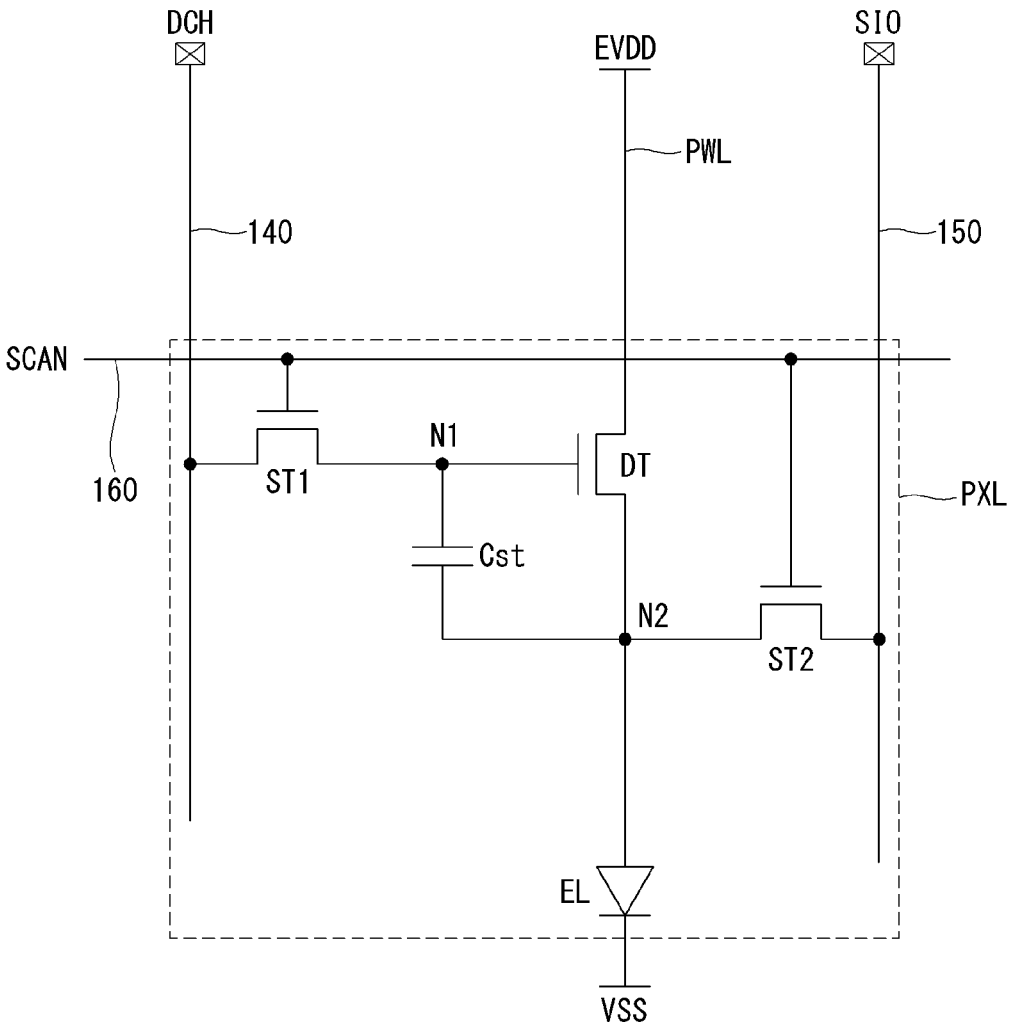
FIG. 4 is an equivalent circuit diagram of a pixel shown in FIG. 3 according to an embodiment of the present disclosure.

FIG. 4 is an equivalent circuit diagram of the pixel PXL shown in FIG. 3.

Referring to FIG. 4, one pixel PXL using the reference voltage lines 150 as a sensing line may include a light emitting element EL, a driving TFT DT, switch TFTs ST1 and ST2, and a storage capacitor Cst. The driving TFT DT and the switch TFTs ST1 and ST2 may be embodied as an NMOS, but the present disclosure is not limited thereto.

The light emitting element EL emits light with intensity corresponding to pixel current input from the driving TFT DT. The light emitting element EL may be embodied as an organic light emitting diode including an organic light emitting layer, or may be embodied as an inorganic light emitting diode including an inorganic light emitting layer. An anode of the light emitting element EL may be connected to a second node N2, and a cathode may be connected to an input terminal of a low potential pixel voltage VSS.

The driving TFT DT may be a driving element for generating pixel current in response to the gate-source voltage. A gate electrode of the driving TFT DT may be connected to a first node N1, a first electrode (drain electrode) may be connected to an input terminal of the high potential pixel voltage EVDD through a high potential power line PWL, and a second electrode (source electrode) may be connected to the second node N2.

The switch TFTs ST1 and ST2 may be switch devices for setting a gate-source voltage of the driving TFT DT and connecting a second electrode of the driving TFT DT to the reference voltage line 150.

The first switch TFT ST1 may be connected between the data lines 140 and the first node N1 and may be turned on according to a scan signal SCAN from the gate line 160. The first switch TFT ST1 may be turned on during set up for display driving or sensing driving. When the first switch TFT ST1 is turned on, the sensing data voltage VSEN or the displaying data voltage VDIS may be applied to the first node N1. The gate electrode of the first switch TFT ST1 may be connected to the gate line 160, the first electrode may be connected to the data lines 140, and the second electrode may be connected to the first node N1.

The second switch TFT ST2 may be connected between the reference voltage line 150 and the second node N2 and may be turned on according to the scan signal SCAN from the gate line 160. The second switch TFT ST2 may be turned on when set-up for display driving or sensing driving, and may apply the displaying reference voltage VPRER or the sensing reference voltage VPRES to the second node N2. The second switch TFT ST2 may also be turned on during a sensing operation after the set-up and may transfer a source node voltage (or a source voltage) of the driving TFT DT to the reference voltage lines 150. The gate electrode of the second switch TFT ST2 may be connected to the gate line 160, the first electrode may be connected to the reference voltage lines 150, and the second electrode may be connected to the second node N2.

The storage capacitor Cst may be connected between the first node N1 and the second node N2 and may maintain a gate-source voltage of the driving TFT DT for a predetermined period. The gate-source voltage of the driving TFT DT for display driving may be set up with a difference voltage between the displaying data voltage VDIS and the sampling reference voltage VREF and the gate-source voltage of the driving TFT DT for sensing driving may be set up with a difference voltage between the sensing data voltage VSEN and a low potential voltage VSS.

Pixel current corresponding to the gate-source voltage of the driving TFT DT during display driving may flow in the driving TFT DT, and the light emitting element EL may emit light due to the pixel current. Pixel current corresponding to the gate-source voltage of the driving TFT DT during sensing driving may flow in the driving TFT DT, the gate-source voltage of the driving TFT DT may saturated with the threshold voltage of the driving TFT DT due to the pixel current, and in this case, the driving TFT DT may be turned off. The sensing reference voltage VPRES may be set to be lower than the displaying reference voltage VPRER, and thus, the light emitting element EL may not emit light during sensing driving.

Figure 5:
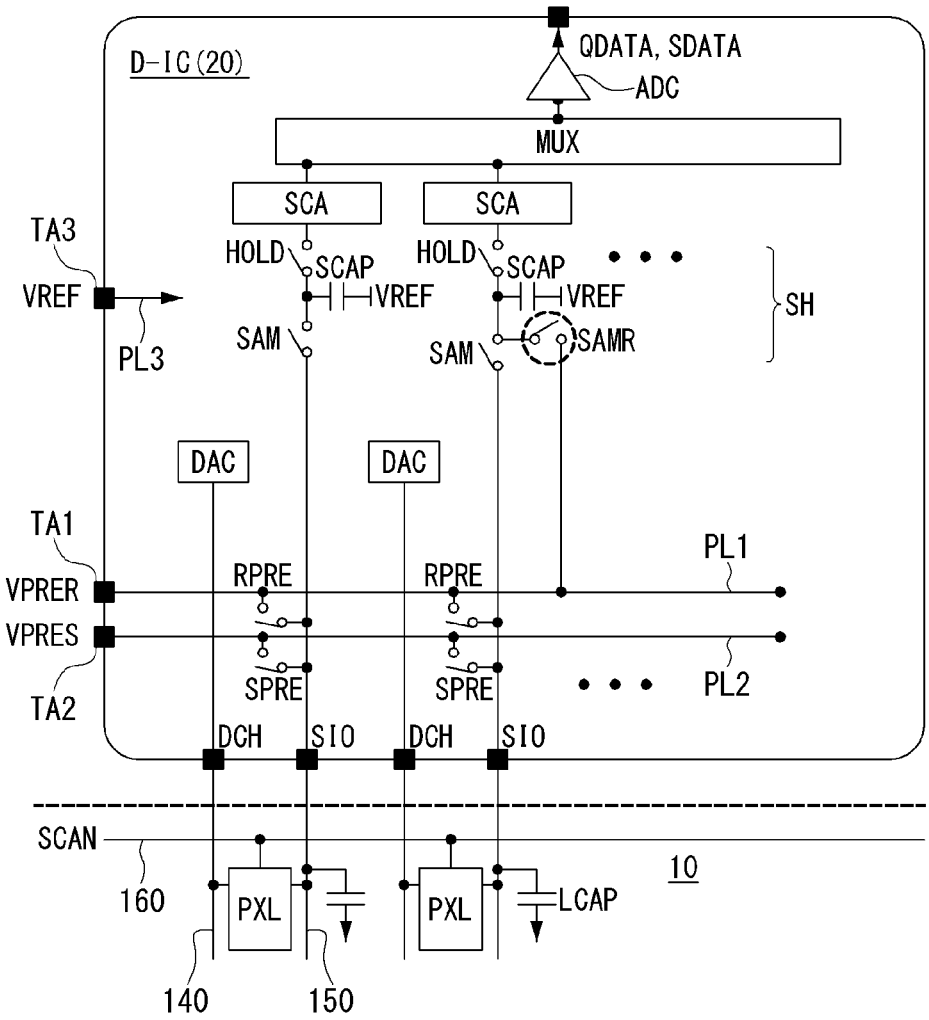
FIG. 5 is a diagram showing a configuration of connection of a sensing device and one pixel according to an embodiment of the present disclosure.
Figure 6:
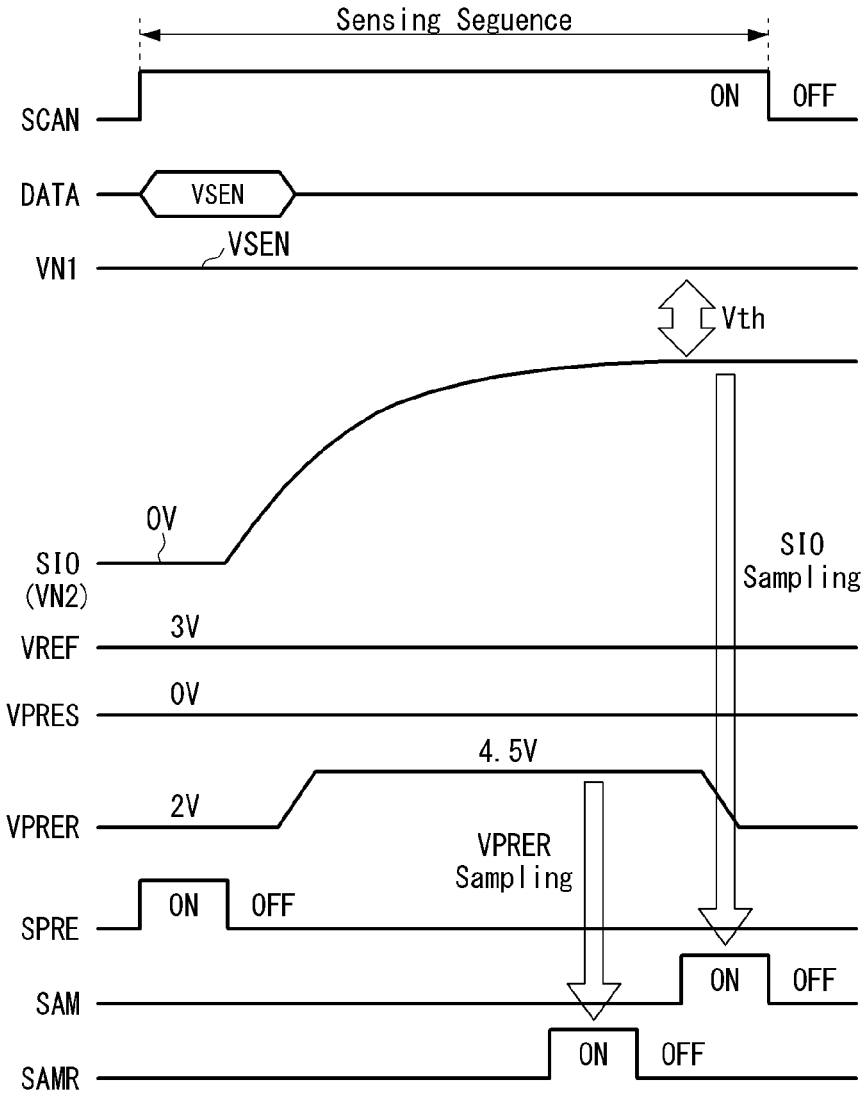
FIG. 6 is a waveform diagram of a sensing device and a pixel of FIG. 5 according to an embodiment of the present disclosure.
Figure 7:
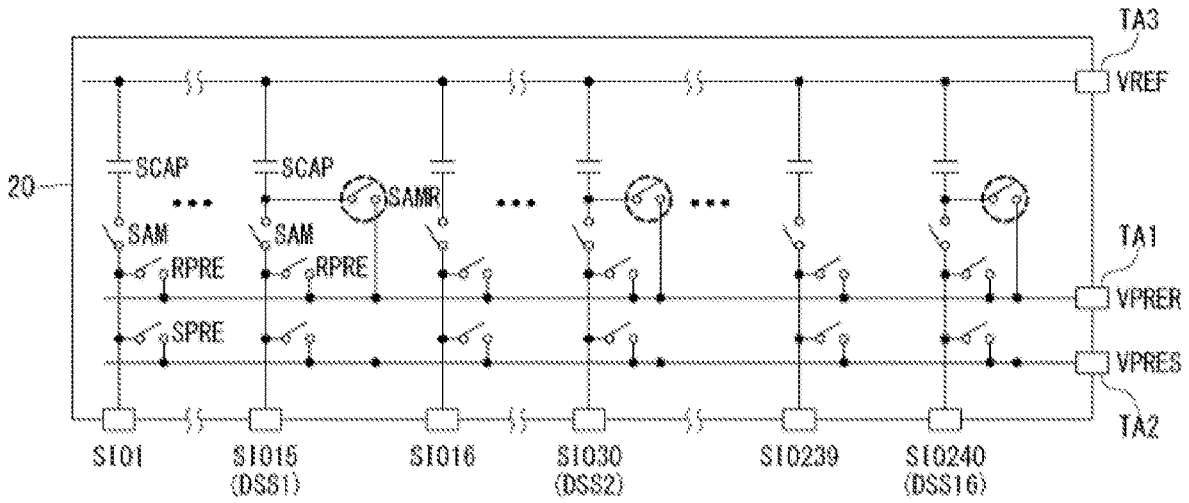
FIG. 7 is a diagram showing the case in which a second sampling switch is connected to 16 sensing channel terminals among 240 sensing channel terminals in FIG. 5 according to an embodiment of the present disclosure.

FIG. 5 is a diagram showing a configuration of connection of a sensing device and one pixel according to an embodiment of the present disclosure. FIG. 6 is a waveform diagram of the sensing device and the pixel of FIG. 5. FIG. 7 is a diagram showing the case in which a second sampling switch is connected to 16 sensing channel terminals among 240 sensing channel terminals in FIG. 5.

Referring to FIG. 5, a sensing device according to an embodiment of the present disclosure may be mounted on the D-IC 20 with the data voltage generator DAC. The data voltage generator DAC may be connected to the data lines 140 of the display panel 10 through the data channel terminal DCH.

The sensing device may include the plurality of sample and holding units SH connected to the sensing line 150 of the display panel 10 through the sensing channel terminal SIO. The sample and holding unit SH may include a first sampling switch SAM, a sampling capacitor SCAP, and a holding switch HOLD. The sample and holding unit SH connected to some sensing channel terminals SIO may further include a second sampling switch SAMR as well as the first sampling switch SAM, the sampling capacitor SCAP, and the holding switch HOLD. The first sampling switch SAM may sample the driving characteristics of the pixel PXL, and may sample the output characteristics of the ADC.

The output characteristics of the ADC may be sensitive to a temperature. That is, even if the same voltage is sensed, sensing result data may be changed depending on the output characteristics of the ADC. This may become serious when there is a deviation in output characteristics of a plurality of ADCs. The deviation in output characteristics of the plurality of ADCs may distort an image, and thus, needs to be sensed and compensated for. The sensing result of the output characteristics of the ADC may be applied as offset or gain during a correction procedure of image data in the same way as the sensing result of the driving characteristics of a pixel.

In order to sense the output characteristics of the ADC, a DC voltage, a sampling switch for sampling the DC voltage, and a sampling capacitor for storing the sampled voltage may be required. However, when the DC voltage may be received from the outside of the D-IC 20 through a power source or the sampling capacitor is additionally designed, the manufacturing cost and size of the D-IC 20 may be increased. In FIG. 5, in order to sense the output characteristics of the ADC, the displaying reference voltage VPRER that is used only in display driving and is not used in sensing driving may be used as a DC voltage without using an additional external power source. In FIG. 5, some of the sampling capacitors used to sense the driving characteristics of the pixel PXL may also be used to sense the output characteristics of the ADC without additionally designing a sampling capacitor. Some of the sampling capacitors may be synchronized with first and second sampling switches that are turned on according to different timings, and a sampling voltage related to the output characteristics of the ADC and a sampling voltage related to the driving characteristics of the pixel PXL may be sequentially stored. When the configuration of FIG. 5 is used, the manufacturing cost and size of the D-IC 20 may be reduced.

With reference to FIGS. 5 to 7, the sensing device according to an embodiment of the present disclosure will be described below in more detail.

The sensing device may include the sensing channel terminal SIO connected to the pixel PXL through the sensing line 150, the first power terminal TA1 to which the displaying reference voltage VPRER is input, the second power terminal TA2 to which the sensing reference voltage VPRES that is different from the displaying reference voltage VPRER is input, the third power terminal TA3 to which the sampling reference voltage VREF is input, the sampling capacitor SCAP having a first electrode to which the sampling reference voltage VREF is applied, a sensing set-up switch SPRE connected between the second power terminal TA2 and the sensing channel terminal SIO, the first sampling switch SAM connected between the sensing channel terminal SIO and the other side electrode of the sampling capacitor SCAP, and the second sampling switch SAMR connected between the first power terminal TA1 and the other side electrode of the sampling capacitor SCAP. The first power terminal TA1 may be connected to a displaying set-up switch RPRE and the second sampling switch SAMR through the first integrated wiring PL1. The second power terminal TA2 may be connected to the sensing set-up switch SPRE through the second integrated wiring PL2. The third power terminal TA3 may be connected to first electrodes of the sampling capacitors SCAP and a reference voltage terminal of the ADC through the third integrated wiring PL3.

Among such components, a component that is newly added to sense the output characteristics of the ADC may be the second sampling switch SAMR. The second sampling switch SAMR may be connected to some of the sampling capacitors SCAP. For example, as shown in FIG. 7, when 240 sensing channel terminals SIO1 to SIO240 are installed in the D-IC 20, the second sampling switch SAMR may be connected to 16 sampling capacitors SCAP among the 240 sampling capacitors SCAP. Sensing channel terminals SIO15, SIO 30, . . . and, SIO 240 corresponding to the 16 sampling capacitors SCAP.

As shown in FIG. 6, in one sensing sequence in which a scan signal applied to a pixel is maintained in an on-level, the first sampling switch SAM and the second sampling switch SAMR may be alternately and selectively turned on, and thus, a sampling voltage related to the output characteristics of the ADC and a sampling voltage related to the driving characteristics of the pixel PXL may be sequentially store in the single sampling capacitor SCAP.

In one sensing sequence, the second sampling switch SAMR may be previously turned on compared with the first sampling switch SAM. While the second sampling switch SAMR is maintained in an on-state, the displaying reference voltage VPRER may be stored in the sampling capacitor SCAP as a sampling voltage related to the output characteristics of the ADC. The ADC may have a predetermined sensing range. The sensing range may include a lower sensing limit and an upper sensing limit. The lower sensing limit may be the sampling reference voltage VREF applied to a sensing voltage terminal, and the upper sensing limit may be higher than the sampling reference voltage VREF. As shown in FIG. 6, when the sampling reference voltage VREF corresponding to the upper sensing limit is 3 V and the upper sensing limit is 6 V, the sensing range may be 3 V to 6 V.

Depending on the sensing range of the ADC, the displaying reference voltage VPRER may be changed to a sensing central value (e.g., 4.5 V) between the lower sensing limit (e.g., 3 V) and the upper sensing limit (e.g., 6 V) from an initial value (e.g., 2 V) required to drive a display in 1 sensing sequence. That is, the displaying reference voltage VPRER stored in the sampling capacitor SCAP may be a sensing central value (e.g., 4.5 V). When the driving characteristics of the ADC are sensed, if the displaying reference voltage VPRER is appropriately adjusted in consideration of the sensing range of the ADC, underflow or overflow of output data of the ADC may be prevented, thereby enhancing sensing accuracy.

The ADC may convert the displaying reference voltage VPRER corresponding to the sensing central value into a digital sensing value, and in this case, the digital sensing value may be changed depending on a temperature. The digital sensing value may be applied as offset or gain in a correction operation of image data. The aforementioned sensing operation related to the output characteristics of the ADC may not be related to a sensing operation of a pixel and may be performed prior to the sensing operation. That is, the sensing operation related to the output characteristics of the ADC may be performed in a state in which the sample and holding unit SH is not connected to the sensing channel terminal SIO.

The sensing operation of a pixel may include a pixel set-up operation and a pixel sampling operation. An ADC sampling operation (i.e., a sampling operation with respect to the displaying reference voltage VPRER) between a pixel set-up operation and a pixel sampling operation may be performed.

The pixel set-up operation may be an operation of applying the sensing data voltage VSEN of a gate electrode (or a first node) of the driving element included in a pixel and applying the sensing reference voltage VPRES to a source electrode (or a second node) of the driving element. For the pixel set-up operation, in 1 sensing sequence, the sensing set-up switch SPRE may be previously turned on compared with the second sampling switch SAMR and may transfer the sensing reference voltage VPRES to the sensing channel terminal SIO. In this case, the DAC may generate the sensing data voltage VSEN and may output the same to the data channel terminal DCH. The sensing data voltage VSEN may be applied to a first node through a first switch TFT, and the sensing reference voltage VPRES may be applied to a second node through a second switch TFT, and thus, current may flow in a driving element. Due to the pixel current, a voltage VN2 of the second node may be increased from the sensing reference voltage VPRES, and the increasing operation may continuously proceed until a gate-source voltage of the driving element is a threshold voltage of the driving element. The driving element may be turned off at a time point at which the gate-source voltage of the driving element is a threshold voltage thereof.

The first sampling switch SAM may be turned on after a voltage between a gate and a source of the driving element is saturated to the threshold voltage of the driving element in 1 sensing sequence. While the first sampling switch SAM is maintained in an on-state, the voltage VN2 of a source of the driving element, which is lower than a gate voltage VN1 of the driving element by a threshold voltage, may be stored in the sampling capacitor SCAP. The first sampling switch SAM may be separately connected to all of the sampling capacitors SCAP, and thus, the aforementioned pixel sensing operation may be simultaneously performed in all sensing channel terminals SIO.

Figure 8:
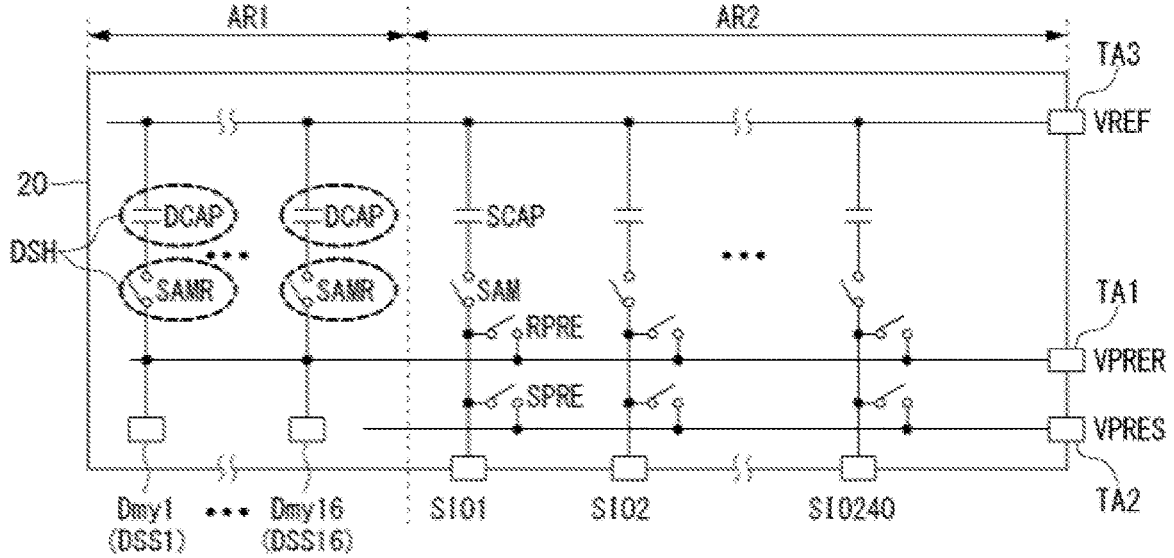
FIG. 8 is a diagram showing a sensing device according to another embodiment of the present disclosure.

FIG. 8 is a diagram showing a sensing device according to another embodiment of the present disclosure.

Referring to FIG. 8, the sensing device according to another embodiment of the present disclosure may be different from the aforementioned sensing device of FIGS. 5 to 7 in that dummy sampling capacitors DCAP are added to a first region AR1 of the D-IC 20 separately from the sampling capacitors SCAP, and the second sampling switches SAMR. The dummy sampling capacitors DCAP and the second sampling switches SAMR that are positioned in the first region AR1 may be included in a dummy sample and holding unit DSH. The dummy sample and holding unit DSH may further include holding switches. However, the sensing device of FIG. 8 may also use the displaying reference voltage VPRER used only for display driving as a DC voltage without use of an additional external power source in order to sense the output characteristics of the ADC like in FIGS. 5 to 7. As such, according to the present disclosure, even if the sensing device is embodied as shown in FIG. 8, the manufacturing cost and size of the D-IC 20 may be reduced to some degree.

With reference to FIGS. 5, 6, and 8, the sensing device according to other embodiments of the present disclosure will be described in more detail.

The sensing device may include the sensing channel terminal SIO connected to the pixel PXL through the sensing line 150, the first power terminal TA1 to which the displaying reference voltage VPRER is input, the second power terminal TA2 to which the sensing reference voltage VPRES different from the displaying reference voltage VPRER is input, the third power terminal TA3 to which the sampling reference voltage VREF is input, the sampling capacitor SCAP having a first electrode to which the sampling reference voltage VREF is applied, the dummy sampling capacitor DCAP having a first electrode to which the sampling reference voltage VREF is applied, the sensing set-up switch SPRE connected between the second power terminal TA2 and the sensing channel terminal SIO, the first sampling switch SAM connected between the sensing channel terminal SIO and the other side electrode of the sampling capacitor SCAP, and the second sampling switch SAMR connected between the first power terminal TA1 and the other side electrode of the dummy sampling capacitor DCAP. The first power terminal TA1 may be connected to the displaying set-up switch RPRE and the second sampling switch SAMR through the first integrated wiring PL1. The second power terminal TA2 may be connected to the sensing set-up switch SPRE through the second integrated wiring PL2. The third power terminal TA3 may be connected to first electrodes of the sampling capacitors SCAP and the dummy sampling capacitors DCAP and the reference voltage terminal of the ADC through the third integrated wiring PL3.

Among such components, a component that is newly added to sense the output characteristics of the ADC may be the dummy sampling capacitors DCAP and the second sampling switch SAMR. The sampling capacitors SCAP and the first sampling switches SAM are positioned in a second region AR2 of the D-IC 20, but the dummy sampling capacitors DCAP and the second sampling switches SAMR may be positioned in the first region AR1 of the D-IC 20. For example, as shown in FIG. 8, when 240 sensing channel terminals SIO1 to SIO240 are installed in the second region AR2 of the D-IC 20, 16 dummy channel terminals DMY1 to DMY16 may be installed in the first region AR1 of the D-IC 20. The dummy channel terminals DMY1 to DMY16 may not be connected to sensing lines and may be DSS1 to DSS16.

As shown in FIG. 6, in one sensing sequence in which a scan signal applied to a pixel is maintained in an on-level, the first sampling switch SAM and the second sampling switch SAMR may be alternately and selectively turned on, and thus, a sampling voltage related to the output characteristics of the ADC and a sampling voltage related to the driving characteristics of the pixel PXL may be sequentially store in the single sampling capacitor SCAP.

In one sensing sequence, the second sampling switch SAMR may be previously turned on compared with the first sampling switch SAM. While the second sampling switch SAMR is maintained in an on-state, the displaying reference voltage VPRER may be stored in the dummy sampling capacitors DCAP as a sampling voltage related to the output characteristics of the ADC. The ADC may have a predetermined sensing range. The sensing range may include a lower sensing limit and an upper sensing limit. The lower sensing limit may be the sampling reference voltage VREF applied to a reference voltage terminal, and the upper sensing limit may be higher than the sampling reference voltage VREF. As shown in FIG. 6, when the sampling reference voltage VREF corresponding to the upper sensing limit is 3 V and the upper sensing limit is 6 V, the sensing range may be 3 V to 6 V.

Depending on the sensing range of the ADC, the displaying reference voltage VPRER may be changed to a sensing central value (e.g., 4.5 V) between the lower sensing limit (e.g., 3 V) and the upper sensing limit (e.g., 6 V) from an initial value (e.g., 2 V) required to drive a display in one sensing sequence. That is, the displaying reference voltage VPRER stored in the dummy sampling capacitors DCAP may be a sensing central value (e.g., 4.5 V). When the driving characteristics of the ADC are sensed, if the displaying reference voltage VPRER is appropriately adjusted in consideration of the sensing range of the ADC, underflow or overflow of output data of the ADC may be reduced, thereby enhancing sensing accuracy.

The ADC may convert the displaying reference voltage VPRER corresponding to the sensing central value into a digital sensing value, and in this case, the digital sensing value may be changed depending on a temperature. The digital sensing value may be applied as offset or gain in a correction operation of image data. The aforementioned sensing operation related to the output characteristics of the ADC may not be related to a sensing operation of a pixel and may be performed prior to the sensing operation. That is, the sensing operation related to the output characteristics of the ADC may be performed in a state in which the sample and holding unit SH is not connected to the sensing channel terminal SIO.

The sensing operation of a pixel may include a pixel set-up operation and a pixel sampling operation. An ADC sampling operation (i.e., a sampling operation with respect to the displaying reference voltage VPRER) between a pixel set-up operation and a pixel sampling operation may be performed.

The pixel set-up operation may be an operation of applying the sensing data voltage VSEN of a gate electrode (or a first node) of the driving element included in a pixel and applying the sensing reference voltage VPRES to a source electrode (or a second node) of the driving element. For the pixel set-up operation, in one sensing sequence, the sensing set-up switch SPRE may be previously turned on compared with the second sampling switch SAMR and may transfer the sensing reference voltage VPRES to the sensing channel terminal SIO. In this case, the DAC may generate the sensing data voltage VSEN and may output the same to the data channel terminal DCH. The sensing data voltage VSEN may be applied to a first node through a first switch TFT, and the sensing reference voltage VPRES may be applied to a second node through a second switch TFT, and thus, current may flow in a driving element. Due to the pixel current, the voltage VN2 of the second node may be increased from the sensing reference voltage VPRES, and the increasing operation may continuously proceed until a gate-source voltage of the driving element is a threshold voltage of the driving element. The driving element may be turned off at a time point at which the gate-source voltage of the driving element is a threshold voltage thereof.

The first sampling switch SAM may be turned on after a voltage between a gate and a source of the driving element is saturated to the threshold voltage of the driving element in one sensing sequence. While the first sampling switch SAM is maintained in an on-state, the voltage VN2 of a source of the driving element, which is lower than the gate voltage VN1 of the driving element by a threshold voltage, may be stored in the sampling capacitor SCAP. The first sampling switch SAM may be separately connected to all of the sampling capacitors SCAP, and thus, the aforementioned pixel sensing operation may be simultaneously performed in all sensing channel terminals SIO.

Figure 9:
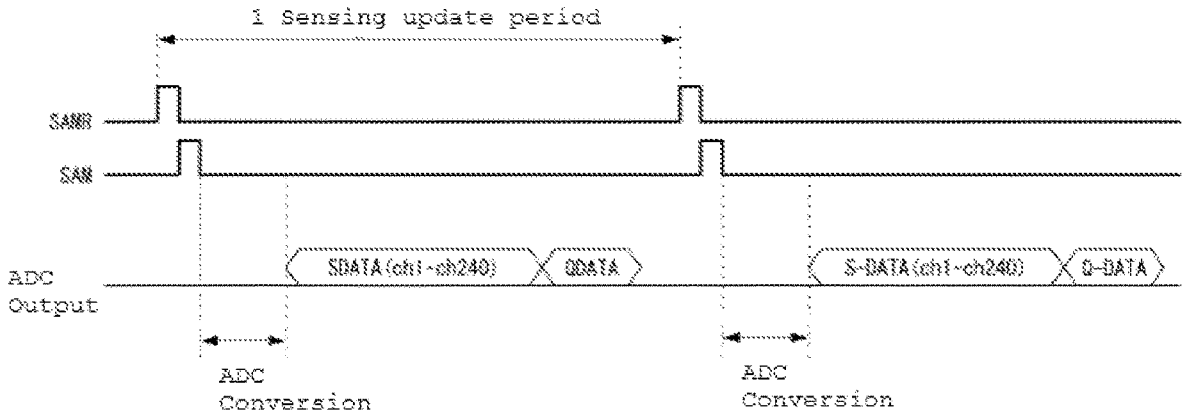
FIG. 9 is a diagram showing output data of an analog to digital converter (ADC) during 1 sensing update period according to an embodiment of the present disclosure.

FIG. 9 is a diagram showing output data of an ADC during one sensing update period.

Referring to FIG. 9, during one sensing update period, the ADC may sequentially receive a first sampling voltage (a displaying reference voltage) obtained in association with the second sampling switch SAMR by a sample and holding unit and a second sampling voltage (a source voltage of a pixel) obtained in association with an operation of the first sampling switch SAM and may convert the first and second sampling voltages into digital values, respectively. The ADC may convert the first sampling voltage into ADC sensing result data QDATA and may convert the second sampling voltage into pixel sensing result data SDATA. The ADC may transmit the pixel sensing result data SDATA and the ADC sensing result data QDATA to a compensation IC.

According to the present disclosure, both the driving characteristics of pixels and the output characteristics of an ADC may be sensed in a single sensing sequence, thereby enhancing compensating capability.

According to the present disclosure, the output characteristics of the ADC may be used using a displaying reference voltage used only for display driving without use of an additional external power source, and thus, the manufacturing cost and size of a driver IC may be reduced.

According to the present disclosure, a sampling capacitor used to sense the driving characteristics of a pixel may be further used to sense the output characteristics of the ADC, thereby reducing the manufacturing cost and size of a driver IC.

The effects according to the present disclosure are not limited to the above examples, and other various effects may be included in the specification.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. A sensing device comprising:

a sensing channel terminal connected to a pixel through a sensing line;

a first power terminal to which a displaying reference voltage is input;

a second power terminal to which a sensing reference voltage different form the displaying reference voltage is input;

a third power terminal to which a sampling reference voltage is input;

a sampling capacitor having a first electrode to which the sampling reference voltage is applied;

a sensing set-up switch connected between the second power terminal and the sensing channel terminal;

a first sampling switch connected between the sensing channel terminal and a second electrode of the sampling capacitor; and a second sampling switch connected between the first power terminal and the second electrode of the sampling capacitor, wherein, in one sensing sequence in which a scan signal applied to the pixel is maintained in an on-level, the first sampling switch and the second sampling switch are alternately and selectively turned on, and wherein, while the second sampling switch is maintained in an on-state, the displaying reference voltage is stored in the sampling capacitor.

2. The sensing device of claim 1, wherein, in the one sensing sequence, the second sampling switch is turned on earlier than the first sampling switch.

3. The sensing device of claim 1, further comprising:

an analog-digital converter having a sensing range including a lower sensing limit and an upper sensing limit and configured to convert input analog sensing values into digital sensing values, wherein the lower sensing limit is the sampling reference voltage, and the upper sensing limit is higher than the sampling reference voltage.

4. The sensing device of claim 3, wherein, within the one sensing sequence, the displaying reference voltage is changed from an initial value required for display driving to a sensing central value between the lower sensing limit and the upper sensing limit, and the displaying reference voltage stored in the sampling capacitor corresponds to the sensing central value.

5. The sensing device of claim 4, wherein a digital sensing value of the displaying reference voltage corresponding to the sensing central value is changed depending on a temperature.

6. The sensing device of claim 2, wherein the first sampling switch is turned on after a gate-source voltage of a driving element included in the pixel is saturated to a threshold voltage of the driving element.

7. The sensing device of claim 6, wherein, while the first sampling switch is maintained in an on-state, a source voltage of the driving element, which is lower than a gate voltage of the driving element by the threshold voltage, is stored in the sampling capacitor.

8. The sensing device of claim 1, wherein the sensing channel terminal corresponds to at least one of a plurality of sensing channel terminals.

9. The sensing device of claim 2, wherein, in the one sensing sequence, the sensing set-up switch is turned on earlier than the second sampling switch and transfers the sensing reference voltage to the sensing channel terminal.

10. An electroluminescence display device comprising:

a display panel including a plurality of pixels, and sensing lines connected to the pixels; and the sensing device of claim 1 including sensing channel terminals connected to the sensing lines.

11. A sensing device comprising:

a sensing channel terminal connected to a pixel through a sensing line;

a first power terminal to which a displaying reference voltage is input;

a second power terminal to which a sensing reference voltage different form the displaying reference voltage is input;

a third power terminal to which a sampling reference voltage is input;

a sampling capacitor having a first electrode to which the sampling reference voltage is applied;

a dummy sampling capacitor having a first electrode to which the sampling reference voltage is applied;

a sensing set-up switch connected between the second power terminal and the sensing channel terminal;

a first sampling switch connected between the sensing channel terminal and a second electrode of the sampling capacitor; and a second sampling switch connected between the first power terminal and a second electrode of the dummy sampling capacitor, wherein, in one sensing sequence in which a scan signal applied to the pixel is maintained in an on-level, the first sampling switch and the second sampling switch are alternately and selectively turned on, and wherein the displaying reference voltage is applied to a source electrode of a driving element included in the pixel through the sensing line for display driving.

12. The sensing device of claim 11, wherein, in the one sensing sequence, the second sampling switch is turned on earlier than the first sampling switch.

13. The sensing device of claim 11, further comprising:

an analog-digital converter having a sensing range including a lower sensing limit and an upper sensing limit and configured to convert input analog sensing values into digital sensing values, wherein the lower sensing limit is the sampling reference voltage, and the upper sensing limit is higher than the sampling reference voltage.

14. The sensing device of claim 13, wherein, within the one sensing sequence, the displaying reference voltage is changed from an initial value required for display driving to a sensing central value between the lower sensing limit and the upper sensing limit and the displaying reference voltage stored in the dummy sampling capacitor corresponds to the sensing central value.

15. The sensing device of claim 14, wherein a digital sensing value of the displaying reference voltage corresponding to the sensing central value is changed depending on a temperature.

16. The sensing device of claim 12, wherein the first sampling switch is turned on after a gate-source voltage of a driving element included in the pixel is saturated to a threshold voltage of the driving element.

17. The sensing device of claim 16, wherein, while the first sampling switch is maintained in an on-state, a source voltage of the driving element, which is lower than a gate voltage of the driving element by the threshold voltage, is stored in the sampling capacitor.

18. The sensing device of claim 12, wherein, in the one sensing sequence, the sensing set-up switch is turned on earlier than the second sampling switch and transfers the sensing reference voltage to the sensing channel terminal.

19. The sensing device of claim 11, wherein the dummy sampling capacitor and the second sampling switch are positioned in a first region of a driver integrated circuit (IC), the sampling capacitor and the first sampling switch are positioned in a second region of the driver IC, and the first region and the second region are separated from each other.

20. An electroluminescence display device comprising:

a display panel including a plurality of pixels, and sensing lines connected to the pixels; and the sensing device of claim 11 including sensing channel terminals connected to the sensing lines.

* * * * *